United States Patent [19]

Hannum

[11] 4,214,456

[45] Jul. 29, 1980

[54] EARRING WITH UNITARY FASTENER

[76] Inventor: Evelyn J. Hannum, 3880 S. Hillcrest, Denver, Colo. 80237

[21] Appl. No.: 930,892

[22] Filed: Aug. 4, 1978

[51] Int. Cl.[2] ..... A44C 7/00

[52] U.S. Cl. ..... 63/12; 24/101 R

[58] Field of Search ..... 63/12, 13; 24/101 R, 24/101 B, 101 W

[56] References Cited

U.S. PATENT DOCUMENTS

| | | | |
|---|---|---|---|
| 180,887 | 8/1876 | Jeanne | 63/13 |
| 220,491 | 10/1879 | Niles | 63/12 X |
| 255,273 | 3/1882 | Flournoy | 24/101 R |
| 599,489 | 2/1898 | Ballou | 24/101 R |
| 2,081,259 | 5/1937 | Abell | 24/101 W |
| 3,446,033 | 5/1969 | Driscoll | 63/12 |
| 4,129,998 | 12/1978 | Ferro | 63/12 |

FOREIGN PATENT DOCUMENTS

| | | | |
|---|---|---|---|
| 809579 | 2/1959 | United Kingdom | 63/12 |

*Primary Examiner*—F. Barry Shay
*Attorney, Agent, or Firm*—Ancel W. Lewis, Jr.

[57] ABSTRACT

An earring for pierced ears has an ornament for display on the outside of the ear and a fastener of unitary construction which is slidable through a pierced opening in the ear lobe for securing the ornament to the ear. The fastener is attached to the ornament and includes a shank portion for insertion into the pierced opening and an ear contact portion coupled to the shank portion by a resilient intermediate portion that positions the ear contact portion transverse to and intersecting the shank portion and is opposite and in spaced relation to the ornament. When on the ear the wearer's ear lobe is compressed between the ornament and the ear contact portion of the fastener under pressure from the intermediate portion so that there is little chance of accidental detachment of the earring from the ear. The fastener is preferably formed of a one-piece metal wire having a uniform cross section throughout its length and curved along its length so that the intermediate portion normally is in the form a closed loop that is selectively opened against pressure exerted by the intermediate portion for placement on and removal from the ear.

16 Claims, 12 Drawing Figures

EARRING WITH UNITARY FASTENER

FIELD OF THE INVENTION

This invention relates generally to jewelry and more particularly to a novel and improved earring for pierced ears including a novel fastener for securing an ornament to an ear lobe.

BACKGROUND OF THE INVENTION

Ornamental earrings for pierced ears are typically secured via a pierced opening in the ear lobe utilizing two-piece mechanical fastening devices. These type earrings generally have a straight post or shank that is placed through the pierced opening in the ear and then fitted with a demountable clasp behind the ear to secure the earring to the ear lobe. Generally, a friction fit between the clasp and the post holds the clasp on the post and against the back of the ear. A problem with such mechanical fastening devices is that, because of their size and required location, they are often difficult to fasten to an ear lobe. In addition, because of their two-piece construction, the clasp is susceptible to loss and accidental detachment from the ear.

Several earrings with one-piece fasteners have been proposed in place of the conventional post and mechanical fastener. Prior fasteners of this type include U.S. Pat. No. 280,726 disclosing an earring having a coiled wire fastener for retaining the earring on an ear lobe. U.S. Pat. Nos. 3,071,938 and 3,260,068 disclose earrings with hook-like wire fasteners for securing the earring to an ear lobe. U.S. Pat. No. 3,446,033 and British Pat. No. 809,579 also disclose earrings with arcuately bent wires to secure the earring to the ear.

While these prior art fasteners using a one-piece wire may be less susceptible to loss and accidental detachment than the two-piece mechanical fastener type earring, most are also difficult to attach to the ear. In addition, the known fasteners on earrings of this type are judged by some to be unattractive and, further, their constructions are not always able to maintain the ornament and the earring in the desired position on the ear.

The present invention is directed to an earring with a unique fastener that overcomes many of the limitations of the prior art.

Accordingly, it is an object of the present invention to provide an ornamental earring with a one-piece or integral fastener that is less subject to accidental detachment from the ear than the prior art fasteners.

Another object of the present invention is to provide an earring with a fastener that is easily attached to the ear and holds the ornament of the earring in a desired position against the ear without discomfort to the wearer.

Still another object of the present invention is to provide an earring and fastener that are of a simple, durable and attractive construction.

Other objects, advantages and capabilities of the present invention will become more apparent as the description proceeds taken in conjunction with the accompanying drawings in which like parts have similar reference numerals and in which.

SUMMARY OF THE INVENTION

Figures 1, 2, 3, 4, 5, 6, 7, 8, 9, 10, 11, 12:
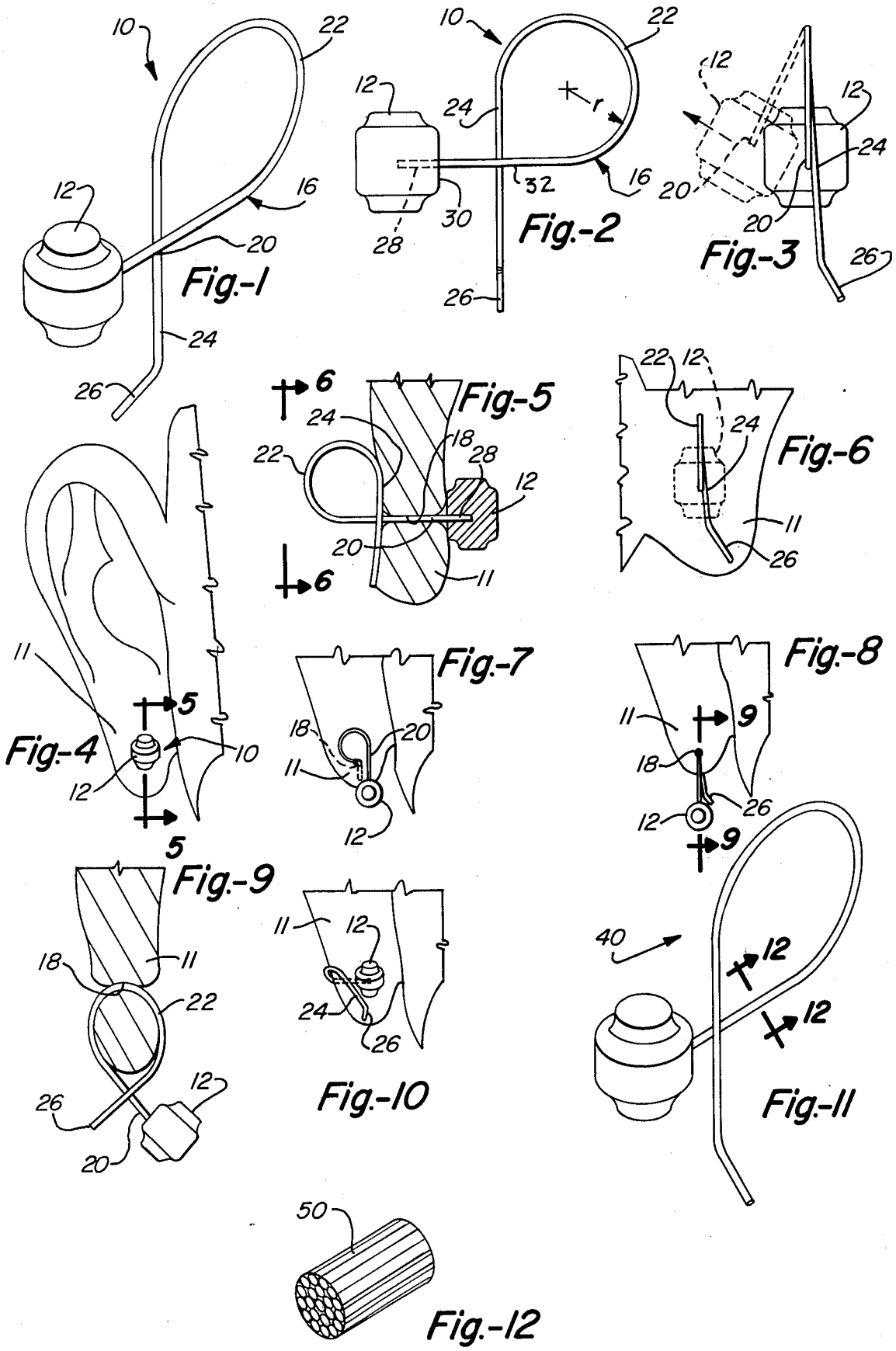
FIG. 1 is a perspective view of an earring of the present invention particularly suited for the right ear.
FIG. 2 is a side elevation view of the earring shown in FIG. 1.
FIG. 3 is an end elevation view of the earring shown in FIGS. 1 and 2 as viewed in a direction looking away from the head and with a spread position for one of the intersecting sections indicated in dashed lines.
FIG. 4 is a front elevation view of the earring shown in FIGS. 1-3 fastened to a right ear lobe.
FIG. 5 is a sectional view taken along line 5—5 of FIG. 4 showing the ear lobe slightly compressed between the ear contact portion and ornament.
FIG. 6 is an elevational view taken along line 6—6 of FIG. 5 as viewed in a direction looking at the back of the right ear lobe and showing the distal portion extending in a direction away from the head.
FIG. 7 is a front elevation view of the right earring with the distal portion extending through the opening in the ear.
FIG. 8 is a front elevation view of the right earring with the loop surrounding the ear lobe.
FIG. 9 is a sectional view taken along line 9—9 of FIG. 8.
FIG. 10 is a front elevation view of the right earring with the ear contact portion on the front of the lobe and the distal portion pointing away from the head prior to their being moved to the back of the ear lobe to the holding position shown in FIGS. 5 and 6.
FIG. 11 is a perspective view of an earring of the present invention particularly suited for the left ear.
FIG. 12 is a sectional view taken along line 12—12 of FIG. 11 showing a segment of stranded cable wire from which the fastener of the present invention may be constructed.

An earring comprising an ornament for display on the outside of an ear lobe and an integral or one-piece fastener for securing the earring to the ear via a pierced opening in the ear. The ornament of the earring may be any conventional ornament such as a polished stone, diamond, bead or the like. The one-piece fastener is preferably a length of wire rigidly attached at one end to the ornament. The fastener includes a shank portion for insertion into the pierced opening of the ear and an ear contact portion transverse to and intersecting with the shank portion and opposite and in spaced relation to the ornament for contacting and compressing the ear against the ornament under light spring pressure from an arcuate resilient intermediate portion. An optional distal portion is turned away from the shank portion to indicate the direction of movement for removal and replacement of the earring.

DESCRIPTION OF THE PREFERRED EMBODIMENTS

Referring now to the drawings, the earring 10 shown in FIGS. 1-3 is particularly suited for use on the lobe 11 of the right ear on which it is mounted and removed as shown in FIGS. 4-10. Generally stated, the earring comprises an ornament 12 for display on the outside of an ear lobe 11 and a fastener 16 for securing the earring to the ear lobe 11 via an orifice or pierced opening 18. In the earring shown the ornament 12 is illustrated as a one-piece, barrel-shaped bead which is rigidly affixed to one end of the fastener 16. It is understood that any other suitable ornament of a different shape may be utilized and that other materials such as diamonds, precious metals, stones or the like may be utilized.

The fastener 16 shown is a slender, continuous string-like piece or filament of relatively rigid or flexible metal, circular in cross section, and preferably is metal wire. The fastener 16 is formed along its length in a particular shape. Proceeding in a direction away from the ornament the fastener generally comprises a straight shank portion 20, a curved, resilient intermediate portion 22 in the form of a spring clip-like closed loop, a substantially straight ear contact portion 24, and a terminal or distal portion 26. In this embodiment using a single piece of metal wire for fastener 16, all of portions 20, 22, 24 and 26 are integral with one another, extremely smooth, and are slidable through the pierced opening 18. The The distal portion 26 is optional and is for the purpose of indicating to the wearer the direction to apply pressure to open the closed loop to place the earring on the ear and to remove the earring, as discussed more fully hereinafter.

Shank portion 20 is shown permanently or rigidly attached at one end to an interior bore 28 within the ornament 12. One end of the shank portion 20 is soldered, welded, or screwed to the bore 28 or otherwise rigidly affixed to the ornament 12. The shank portion 20 of the fastener is longitudinally straight and smooth and, as shown in FIG. 5, slidably inserts into and fits within the pierced opening 18 of the ear 14 when the earring 10 is being worn. The shank portion 20 is attached to the ornament 12 along an axis approximately perpendicular to a back surface 30 of the ornament 12 and extends away from the ornament 12.

Resilient intermediate portion 22 connects or couples the shank portion 20 to the ear contact portion 24 and as shown is of an arcuate configuration formed with an arc of a radius "r". The intermediate portion 22 is formed continuously with the end of the shank portion 20 opposite the ornament. Beyond the ear contact portion there is a straight section 32 that may be considered a straight extension of the shank portion 20 or a part of the intermediate portion 22, but in any event the intermediate portion 22 then loops away from and then back toward shank portion 20 of the fastener 16 in an arc. The curvature of the arc along the radius "r" extends through an angle of approximately 270°. The center of the radius "r" is located a selected distance from the longitudinal axis of the shank portion at one end of the shank portion opposite the ornament. The curve in portion 22 intersects portion 32 at approximately the point of tangency of the arc of intermediate portion 22 and the longitudinal axis of portions 20 and 32. In addition, the intermediate portion 22 intersects ear contact portion 24 of the fastener at approximately the point of tangency of the arc of the intermediate portion 22 and the longitudinal axis of the ear contact portion 24.

The looped intermediate portion 22 then extends through a selected radius along a curve that is a curved extension of the longitudinal axis of the shank portion and in a plane common to the plane of the shank portion 20. The intersecting parts of shank portion 20 and ear contact portion 24 abut or are held in contact against one another by the intermediate portion to form a closed loop.

The ear contact portion 24 shown is a straight section formed continuously with intermediate portion 22 and is located along an axis transverse to, and more specifically is perpendicular to, the axis of the shank portion 20 and parallel and in spaced relation to back surface 30 of the ornament 12. Moreover, the ear contact portion 24 intersects the shank portion 20 adjacent one end thereof. The ear contact portion 24 is formed such that the distance between the ear contact portion 24 and back surface 30 of the ornament 12 is slightly less than the thickness of a normal ear lobe.

The shape and material for the intermediate portion and its relationship to the shank and ear contact portions as shown are such that, when a pressure is exerted by the user to widen the spacing between the ornament and ear contact portion and/or when the intersecting parts are spread apart to open the loop, the intermediate portion is deformed and placed under tension. When the deforming pressure is removed resiliency and elasticity of the intermediate portion 22 return the parts to the original at-rest position shown in FIG. 1.

When the earring is worn, the wearer's ear lobe 11 is held under a slight pressure or is compressed between the surface of ear contact portion 24 and the back surface 30 of the ornament 12 under spring clip-like tension from the resilient intermediate portion 22 to hold the ornament in place. The earring 10 can thus be firmly secured to the ear.

The distal or terminal portion 26 of the fastener 22, which is optional, is formed continuously with ear contact portion 24 but is bent to extend in a direction away from the shank portion 20 to indicate to the wearer the direction in which to apply pressure to separate the intersecting parts.

The fastener 16 of the earring 10 may be fabricated from a lightweight springy material such as light gauge solid metal wire, stainless steel, spring metal, braided metal wire, or one-piece synthetic material. Alternatively, it has been found that the fastener may be made of a stranded metal cable, as illustrated by member 50 in FIG. 12. An example of a material found suitable is a metal stranded cable consisting of seven strands each 0.006 inch with a total outer diameter of about 0.018 inch.

As shown in FIG. 2, while the earring is worn the resilient or spring clip-like force produced by looped intermediate portion 22 on ear contact portion 24 tends to lightly compress the ear lobe 11 between the back surface 30 of the ornament 12 and the surface of the ear contact portion 24. This force is dependent on the gauge and type of material utilized for the fastener 22, on the distance between the ear contact portion 24 and the ornament 12, and on the length of radius "r". With the proper selection of these parameters the spring force is set such that the earring 10 can be firmly secured to the ear lobe 11 without causing discomfort to the wearer.

In addition to the spring force generated by the resilience of intermediate portion 22 on ear contact portion 24, the natural resiliency of the material tends to bias the ear contact portion 24, as shown in FIG. 5, into abutment with shank portion 20 of the fastener. This arrangement maintains the fastener 22 in a compact position while the earring is worn. The fastener 22, however, may be spread apart as shown in FIG. 3 for sliding the fastener 16 through the pierced opening 18 in the wearer's ear lobe 11.

In placing the earring on the wearer's ear the loop is held in one hand and the distal portion is inserted through the opening in the ear lobe from front to back toward the head, as shown in FIG. 7. The emerging distal portion is grasped by one hand and the ornament with the other hand and the distal portion is pulled in the direction that it is bent to gently separate the parts of the loop at the intersection, as shown in dashed lines in FIG. 3. The loop now extends around the ear lobe and the ornament and distal portion will depend from the loop, as shown in FIGS. 8 and 9.

The ornament is then moved to approximately the normally worn position on the front of the ear lobe and in this position the ear contact portion is also in front of the ear lobe, as shown in FIG. 10. The ornament is then rotated about the axis of the shank portion, if necessary, until the loop is up and the distal portion is pointing away from the head. This leaves the ornament in a slightly distorted position and the distal portion in front of the ear lobe adjacent the outer edge of the ear lobe with the loop arranged to be opened by the application of a pulling force in the direction of the bend of the distal portion, as shown in FIG. 10. With the application of this pulling force the distal portion and ear contact portion slip over the outer edge portion of the ear lobe and into place on the back side of the ear lobe with the ear lobe held under pressure between the back of the ornament and the ear contact portion.

In the fastened position the earring is firmly secured to the wearer's ear with little chance of its being accidentally separated from the ear. In addition, since the fastener is rigidly affixed to the ornament, it cannot be lost or accidentally dislodged from the ear as is the case with conventional mechanical fasteners.

For removal of the earring the above outlined procedure is essentially reversed. Pressure is first applied to the distal portion in the direction of its bend to separate the contact and shank portions at the intersection, causing the earring to assume a depending position supported by the loop, as shown in FIGS. 7 and 8. The ear contact and shank portions are again separated at the intersection to open the loop, with the ear contact and distal portions then passed through the pierced opening from back to front.

Referring now to FIG. 11, an earring 40 shown has the same fastener as above described but the ear contact portion extends on the opposite side of the shank portion and the terminal portion turns in the opposite direction to facilitate the separation of the intersecting parts. While the earrings 10 and 40 above described are referred to as left and right, it is understood that the right earring 10 may be used on the left ear. The only difference would be that on the left ear the loop of earring 10 would point down and the distal portion 26 would point up. In both cases the distal portion 26 would point away from the head and would be removed by applying pressure in that direction to separate the intersecting parts.

Although the present invention has been described with a certain degree of particularity, it is understood that the present disclosure has been made by way of example and that changes in details of structure may be made without departing from the spirit thereof.

What is claimed is:

1. An earring for an ear having a lobe with an opening comprising:

an ornament; and a fastener for said ornament including a shank portion attached to said ornament, and an ear contact portion coupled to said shank portion by a resilient intermediate portion, said portions being integral with one another and sequentially slidable through an opening in an ear lobe, said ear contact portion having a first end and a second end and extending substantially perpendicular to and intersecting said shank portion and disposed opposite and spaced from said ornament a selected distance, said ear contact portion being resiliently held at said first end by said intermediate portion whereby the ear lobe is held between said ear contact portion against one face of the lobe and said ornament against the opposite face of the lobe by opposed pressure exerted by said intermediate portion, said second end extending beyond said intersection with the shank portion.

2. An earring as set forth in claim 1 wherein said shank, ear contact and intermediate portions are formed of a one-piece filament of substantially uniform cross section throughout its length.

3. An earring as defined in claim 1 wherein said fastener has a distal portion that is an extension of said second end of said ear contact portion, said distal portion extending away from said shank portion so that, when pressure is applied in the direction in which said distal portion extends, said ear contact portion is separated from said shank portion at said intersection to facilitate the removal and replacement of said earring.

4. An earring as set forth in claim 1 wherein said intermediate portion has an arcuate configuration and extends along an arc of selected radius having a center located a selected distance from the longitudinal axis of said shank portion and at one end of the shank portion opposite said ornament forming a loop continuous with said shank portion and said ear contact portion.

5. An earring as defined in claim 1 wherein said ear contact portion extends substantially parallel to a back surface of said ornament, said ear contact portion being resiliently urged by said resilient portion to normally abut said shank portion at said intersection and separate at said intersection in opposition to the elastic force in said intermediate portion.

6. An earring as defined in claim 1 wherein said intermediate portion extends away from and is doubled back toward said shank portion through an angle of approximately 270°.

7. An earring as defined in claim 1 wherein said fastener is a length of continuous, slender wire of substantially uniform circular cross section throughout its length.

8. An earring as defined in claim 7 wherein said one-piece fastener is a solid metal wire.

9. An earring as defined in claim 7 wherein said one-piece fastener is stranded metal cable.

10. An earring as defined in claim 7 wherein said wire is stainless steel.

11. An earring as defined in claim 1 wherein said fastener is formed from a thin, slender, one-piece, molded synthetic material.

12. An earring as set forth in claim 1 wherein said shank portion and resilient intermediate portion extend in a common plane.

13. An earring for an ear with a lobe having a pierced opening comprising:

an ornament; and a fastener of unitary construction and slidable sequentially through a pierced opening in an ear lobe for securing said ornament to said ear lobe via the pierced opening, said fastener including a substantially straight shank portion attached at one end to said ornament, an arcuate, resilient, intermediate portion looped away from the other end of said shank portion and then doubled back toward said shank portion in a plane common to said shank portion, and an ear contact portion substantially perpendicular to the shank portion and extending beyond said intermediate portion and said shank portion and spaced from said ornament a distance less than the thickness of the ear whereby when on the ear said shank portion extends through the pierced opening and the ear lobe is compressed between said ear contact portion and said ornament under pressure from said intermediate portion.

14. An earring for an ear with a lobe having a pierced opening therethrough, said earring comprising:

an ornament;

a one-piece fastener for securing said ornament to said ear lobe, said fastener having a substantially straight shank portion attached at one end to said ornament and extending away from said ornament, a generally arcuately shaped, spring clip-like, intermediate portion formed continuously with said shank portion and looped away from and then back toward said shank portion through an angle of approximately 270°, and an ear contact portion formed continuously with said spring clip portion and extending therefrom along an axis substantially perpendicular to, intersecting and continuing beyond said shank portion and disposed generally opposite and parallel to a back surface of said ornament and spaced away from said back surface a distance less than the thickness of the ear whereby said shank portion may be placed through the pierced opening with the ear lobe compressed between said ear contact portion and said back surface under spring pressure from said intermediate portion.

15. An earring as defined in claim 14 wherein said ear contact portion is formed to normally abut said shank portion at said intersection thereof and is spread apart against resilient forces exerted by said intermediate portion at said intersection for placing said earring on the ear and removing said earring from the ear.

16. An earring as defined in claim 14 wherein said intermediate portion is in the form of a spring clip-like loop that extends through an arc of selected radius formed along a curve that is a curved extension of the longitudinal axis of said shank portion and in a plane common to the plane of the shank portion.

* * * * *